United States Patent [19]

Isozumi et al.

[11] Patent Number: 5,065,039

[45] Date of Patent: Nov. 12, 1991

[54] COAXIAL STARTER WITH A CORE AND CONTACT TERMINAL ASSEMBLY

[75] Inventors: Shuzoo Isozumi; Keiichi Konishi, both of Himeji, Japan

[73] Assignee: Mitsubishi Denki K.K., Tokyo, Japan

[21] Appl. No.: 455,043

[22] Filed: Dec. 22, 1989

[30] Foreign Application Priority Data

Dec. 22, 1988 [JP] Japan ..... 63-327029
Feb. 20, 1989 [JP] Japan ..... 1-40635

[51] Int. Cl.[5] ..... F02N 11/02
[52] U.S. Cl. ..... 290/48
[58] Field of Search ..... 290/48

[56] References Cited

U.S. PATENT DOCUMENTS 4,760,274 7/1988 Isozumi ..... 290/48

FOREIGN PATENT DOCUMENTS 0277566 1/1988 European Pat. Off. .
52773 11/1982 Japan .
140864 6/1988 Japan ..... 290/48
105461 7/1988 Japan .

*Primary Examiner*—A. D. Pellinen
*Assistant Examiner*—Robert L. Hoover
*Attorney, Agent, or Firm*—Sughrue, Mion, Zinn, Macpeak & Seas

[57] ABSTRACT

A coaxial starter in which a motor armature rotary shaft, an axially slidable output rotary shaft having a pinion at its front end and a solenoid switch disposed behind the motor are arranged on a common aixs. A portion of an iron core of the solenoid switch is extended such that the iron core portion journals the armature rotary shaft and separates a space containing a brush and a commutator of the motor from an interior space of the solenoid switch, and that the iron core portion has mounted thereon, through an insulating material, a power source side stationary contact and a brush side stationary contact. Also disclosed is a core and contact terminal assembly for a solenoid switch, comprising a casing containing therein a coil with a bobbin, a plunger slidably inserted into a bush mounted within the bobbin and a disc-shaped core disposed at an axial end portion of the casing. A movable contact on the plunger is engageable with two stationary contacts, and portions of the disc-shaped core is removed so that main body portions of the two stationary contacts are disposed therein, and the main body portions of the stationary contacts together with some portion of the core are secured by embedding them into resin material.

4 Claims, 12 Drawing Sheets

COAXIAL STARTER WITH A CORE AND CONTACT TERMINAL ASSEMBLY

BACKGROUND OF THE INVENTION

This invention relates to a coaxial starter in which a motor armature rotary shaft, a rod of a solenoid switch and an output rotary shaft are arranged on a common axis and, more particularly, to a coaxial starter with a core and contact terminal assembly in which an iron core of a solenoid switch and contact terminals are assembled in a unit.

FIG. 1 is a sectional view illustrating the structure of a conventional coaxial starter. In the figure, reference numeral 1 indicates a d.c. motor, 2 indicates its armature, which is integral with a hollow armature rotary shaft 3. An insertion shaft portion 4*a* of an output rotary shaft 4 is inserted within an inner passage 3*a* of the armature rotary shaft 3 and is axially slidably supported by a sleeve bearing 5 securely fitted within the inner circumference portion of the inner passage 3*a*. A drive power transmission mechanism 6 comprising a planetary gear speed reduction mechanism 7 and an over-running clutch mechanism 8 is disposed for transmitting a drive power from the armature rotary shaft 3 to the output rotary shaft 4.

The planetary gear speed reduction mechanism 7 comprises a sun gear 7*a* formed on the outer circumference of the front end of the armature rotary shaft 3, planetary gears 7*b* meshing with the sun gear 7*a*, a clutch outer member 8*a* to which center pivot shafts 7*c* are secured and constituting a planetary gear arm 7*b*, and an inner gear 7*d* formed in the inner circumference portion of a front bracket 9 and in mesh with the planetary gears 7*b*. Further, the over-running clutch mechanism 8 comprises the clutch outer member 8*a*, a clutch inner member 8*b* and rollers 8*c* interposed therebetween, and the clutch inner member 8*b* is in spline-mesh with helical splines 4*c* formed on the large-diameter portion 4*b* of the output rotary shaft 4. On the front end portion of the output rotary shaft 4, a pinion 10 which engages with the engine ring gear when it is moved forward.

Further, reference numeral 11 indicates a solenoid switch disposed behind the d.c. motor 1, and 11*a* is its stationary contact, 11*b* a movable contact, 11*c* is a plunger rod, and 12 indicates a cover for covering the rear end.

In the coaxial starter of such construction, the solenoid switch 11 actuates to energize the d.c. motor 1 to generates rotation thereof, which rotation is transmitted to the pinion 10 through the planetary gear speed reduction mechanism 7 and the over-running clutch mechanism 8. Also, by the forward movement of the plunger rod 11*c* of the solenoid switch 11, the output rotary shaft 4 is driven forward to bring the pinion 10 into engagement with the engine ring gear. Thus, the engine is started, and after the starting, the over-running clutch mechanism 8 functions to allow idle rotation of the pinion 10 side, thereby preventing the reverse drive of the d.c. motor 1 from the engine side.

In the above-described conventional coaxial starter, however, the stationary contact 11*a* is disposed behind the solenoid switch mechanism 11 and further the movable contact 11*b* which contacts to the stationary contact 11*a* as well as the cover 12 are mounted, so that a problem that the overall length becomes very long and interfers the portion of the engine is raised.

In order to solve the above problems, the assigner of the present invention has previously proposed a coaxial starter as shown in FIGS. 2 and 3. In these figures, FIG. 2 is a side view of the coaxial starter and the sectioned portion mainly shows the solenoid switch portion, and FIG. 3 is an exploded perspective view of the brush assembly. In FIG. 2, the coaxial starter 20 comprises a d.c. motor 26 composed mainly of a permanent magnet 22 securely mounted on the inner circumferential surface of a yoke 21 defining a magnetic path and an outer wall at predetermined circumferential intervals, an armature 23 rotatably disposed at the central portion of the yoke 21, and a commutator 24 disposed on the rear end side of the armature 23 and to the circumference of which the brush 25 is arranged, as well as a drive power transmission mechanism and an over-running clutch mechanism not illustrated in the sectional view. The armature 23 of the d.c. motor 26 is composed of a hollow armature rotary shaft 27, an armature core 28 integrally mounted to the outer circumference of the armature rotary shaft 27, and an armature coil 29 inserted into the armature core 28 and connected at its rear end to the commutator 24. An output rotary shaft 30 is disposed on the inner front side of the hollow armature rotary shaft 27, and a pinion 31 is mounted on the front end portion of the output rotary shaft 30. Since the components not sectioned in FIG. 2 are similar to those of the construction of the coaxial starter shown in FIG. 1, their descriptions are omitted. The brush 25 is housed in a brush holding portion 32*a* of a brush holder 32 made of plastic material, and the brush holder 32 has integrally formed therein an external terminal thread portion 33*a* for connecting a cable (not shown) from the power source, a source side stationary contact 33 connected to the external terminal thread portion 33*a* and a brush side stationary contact 34 connected to the brush 25. Reference numeral 35 indicates a substantially cup-shaped housing, the inner circumferential surface of which has fitted thereon a bearing 36 for supporting the rear end of the armature rotary shaft 27, and which has an outer wall covering the brush holder 32 and is securely fitted on the rear portion of the yoke 21, the rear end of which being in contact at its projection surface T with a core 40 which will be described later. A screw 37 is disposed to connect the brush holder 32 and the housing 35.

The above-described stationary contacts 33 and 34 project rearwardly from the through hole 35*a* formed in the housing 35, of which construction will be explained with reference to FIG. 3. In FIG. 3, 34 is the stationary contact connected to the brush 25 and is insert-molded in the brush holder 32 and is connected to the brush 25 by an unillustrated lead wire. The source side stationary contact 33 is connected to the external terminal thread portion 33*a* and is also insert-molded. The mold face M is in abutment with the core 40 which will be described later in flush with the projection face T of the housing 35. The stationary contacts 33 and 34 are inserted into the through hole 35*a* of the housing 35 and are arranged so that the contact faces are located behind the end face of the housing 35 and in opposition to the movable contact 46 of the solenoid switch 38. Also, arrows in FIG. 3 indicate the order of assembly, from which it is seen that the brush holder 32 is placed on the commutator 24, and then the housing 35 is placed to cover the brush holder 32 with the stationary contacts 33 and 34 projected rearward.

In the solenoid switch 38, 40 indicates iron core portion defining together with the casing 39 a magnetic path, which iron core portion 40 supports an excitation coil 42 wound around a plastic bobbin 41. In the inner circumference of the bobbin 41, a plunger 43 is mounted slidably along the inner circumference surface, the plunger 43 having secured thereto one end of a tubular rod 44 made of non-magnetic stainless steel. The other end of the rod 44 is positioned within the inner passage of the armature rotary shaft 27, and the rod 44 has the movable contact 46 held thereon through an insulating material 45 so that the movable contact 46 contacts with the stationary contacts 33 and 34 as the plunger 43 moves. Further, a push rod 47 is slidably inserted into the interior of the rod 44 and is biased in the forward direction by a coil spring 48. The push rod 47 is disposed within the armature rotary shaft 27 and its front end is in abutment through a steel ball 49 with the bottom wall of the recessed portion formed in the rear end portion of the output rotary shaft 30. A coil spring 50 is disposed outside of the push rod 47 to urge the steel ball 49 in a predetermined position. Also, reference character 51 indicates a plate of a non-magnetic material covering the rear end of the solenoid 38, 52 is a through bolt for fastening the above mechanisms and components, 53 is a seal member and 54 indicates an internal space (contact chamber) of the solenoid switch 38.

Then, the operation of the coaxial starter of the above construction will now be explained. When the unillustrated vehicular starter switch is closed, the solenoid switch 38 is energized. This causes the plunger 43 to move forward together with the tubular rod 44 to compress the inside coil spring 48, so that an urging force is applied to the push rod 47 to drive the output rotary shaft 30 in the forward direction. Also, the movable contact 46 of the solenoid switch 38 abuts against the stationary contacts 33 and 34 to connect the d.c. motor 26 to the power source so that the d.c. motor 26 generates the rotational force. This rotational drive force is transmitted to the output rotary shaft 30 through the drive force transmitting mechanism not shown in the drawings, and the pinion 31 which is in mesh with the ring gear by the forward movement of the output rotary shaft 30 is rotated to start the engine. When the power supply to the solenoid switch 38 is interrupted after starting the engine, the output rotary shaft 30 is returned to its home position by return springs suitably provided, disengaging the pinion 31 from the ring gear.

The coaxial starter thus constructed is advantageous in that the axial length of the starter can be significantly shortened and the number of parts can be decreased, but needs the housing 35 and the brush holder 32 of complicated shape, and is strongly demanded that the number of the parts be further decreased.

Also, since the through hole 35*a* is formed in the housing having the bearing support portion of the armature rotary shaft 27, the bearing strength is low and the housing cannot be made light-weight impeding a light-weight starter.

Further, there has been remained a problem that the brush particles generated due to the sliding contact of the brush 25 to the commutator 24 can easily enter into the space in which the sliding surfaces of the movable contact 46 and the plunger 43 are located (contact chamber 54). That is, since the above-described coaxial starter has a structure in which the housing 35 is assembled behind the brush holder 32, some room is necessary in the dimension of the through hole 35*a* through which the stationary contacts 33 and 34 extend. Therefore, upon the movement or the like of the plunger 43, the brush particles enter into the contact chamber 54 from the central opening of the brush holder 32 through the clearance defined between the through hole 35*a* and the stationary contacts 33 and 34, and therefore, problems are posed in that the brush particles thus entered attach and accumulate on the sliding surface of the plunger 43 in the inner circumference of the bobbin 41, impeding desirable sliding movement, and the brush particles thus entered attach to the contact surfaces of the movable contact 46 as well as the stationary contacts 33 and 34, causing poor contact therebetween.

FIG. 4 illustrates another conventional coaxial starter which is constructed such that an armature rotary shaft 102 of a d.c. electric motor 101 is made hollow, a push rod 104 supported by a plunger rod 103*a* of a solenoid switch 103 disposed at the rear end of the d.c. motor 101 is inserted into an inner passage 102*a* of the armature rotary shaft 102 so that it abuts against an end face of the rear end portion of an output rotary shaft 105, which is coaxially disposed at the front end of the armature rotary shaft 102, inserted into the inner passage 102*a* of the armature rotary shaft 102, whereby the output rotary shaft 105 can be pushed out in the forward direction.

In the coaxial starter thus constructed, a commutator 106 is mounted to the rear portion of the armature rotary shaft 102*a*, and brushes 109 held by holders 108 secured to a mounting plate 107 are arranged to slidably contact around the commutator 106. Behind a commutator assembly comprising the commutator 106, the brushes 109 and the holders 108 and between the assembly and the solenoid switch 103, a terminal assembly 112 in which two terminal bolts 110 and 111 are resin molded, and are mounted in notches formed in the circumference surface of a rear bracket 101*b* as shown in FIG. 4, and on one side face of this terminal assembly 112, two stationary contacts 114 and 115 connectable to each other by a movable contact 113 of the solenoid switch 103 are mounted to project therefrom. Each stationary contact 114 or 115 is formed integral with the terminal bolt 110 or 111 and is hence electrically connected to the terminal bolt 110 or 111.

Two terminal bolts 110 and 111 are connected at one of them to a battery B mounted on a vehicle by a line 116, and connected at the other of them to the brush 109 of the positive side by a line 117 as well as to a lead-in portion of a coil 118 of the solenoid switch.

In FIG. 4, reference numeral 119 indicates a pinion mounted to the front end portion of the output rotary shaft 105 and capable of engaging with and disengaging from an engine ring gear (not shown) by the reciprocating motion of the output rotary shaft 105, 120 indicates a planetary speed reduction gear for reducing the rotation of the armature rotary shaft 102, and 121 indicates an over-running clutch for transmitting the rotation speed-reduced by the planetary speed reduction gear 120 to the output rotary shaft 105 and for preventing the reverse transmission of the rotation of the output rotary shaft 105 to the d.c. motor 101 when the former is driven by the engine at a high speed.

However, in the coaxial starter as above described, the terminal assembly 112 and the iron core 122 which is one componet of the solenoid switch 103 are formed as separate parts, so that the cost is increased due to the increased number of the components and the reliability of the product is low because the terminal assembly 112 is only mounted in the notch of the rear bracket 101*b* and the support is not strong enough. Also, since the stationary contacts 114 and 115 are adjacent to the core 112 even though they are disposed along an axial direction, the overall length of the starter is increased.

SUMMARY OF THE INVENTION

Accordingly, one object of the present invention is to provide a coaxial starter free from the above discussed problems of the conventional coaxial starter.

Another object of the present invention is to provide a coaxial starter which is simple in structure and light in weight.

A further object of the present invention is to provide a coaxial starter which can prevent ingress of the brush particles into the contact chamber of the solenoid switch.

Still another object of the present invention is to provide a core and contact terminal assembly in which the core of the solenoid switch and the contacts are combined into a single unit.

Another object of the present invention is to provide a core and contact terminal assembly which reduces the number of components, provides a sufficient support strength and decreases the axial dimension of the coaxial starter.

According to the coaxial starter of the present invention, an iron core portion of a solenoid switch journals an armature rotary shaft, and a motor and the solenoid switch is separated by the iron core portion, and the iron core portion has mounted thereon through an insulating material the stationary contact. Therefore, no additional member for holding the stationary contact is necessary separate from the iron core portion, so that the structure can be simplified. Also since there is no large opening and made of iron, the strength of the bearing can be increased. Also, the brush particles can be prevented by the iron core from entering into the contact chamber of the solenoid switch.

Also according to the core and contact terminal assembly of the present invention, some portion of a disc-shaped core which is disposed at the axial end portion of a casing of a solenoid switch, is removed to form windows, and main body portions of stationary contacts are disposed in the removed portion, and the main body portions of the stationary contacts together with one portion of the core are secured by partially embedding them into resin material. Therefore, the main body portions of the stationary contacts to which the movable contact of the solenoid switch are brought into contact are disposed in windows formed in the core to position the core and the stationary contacts on substantially the same plane. The main body portions of the stationary contacts are embedded into the resin material together with a portion of the core to secure them together. The core and the contact terminal assembly thus obtained is disposed and assembled at an axial end portion of the casing of the solenoid switch as a single component.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 7:
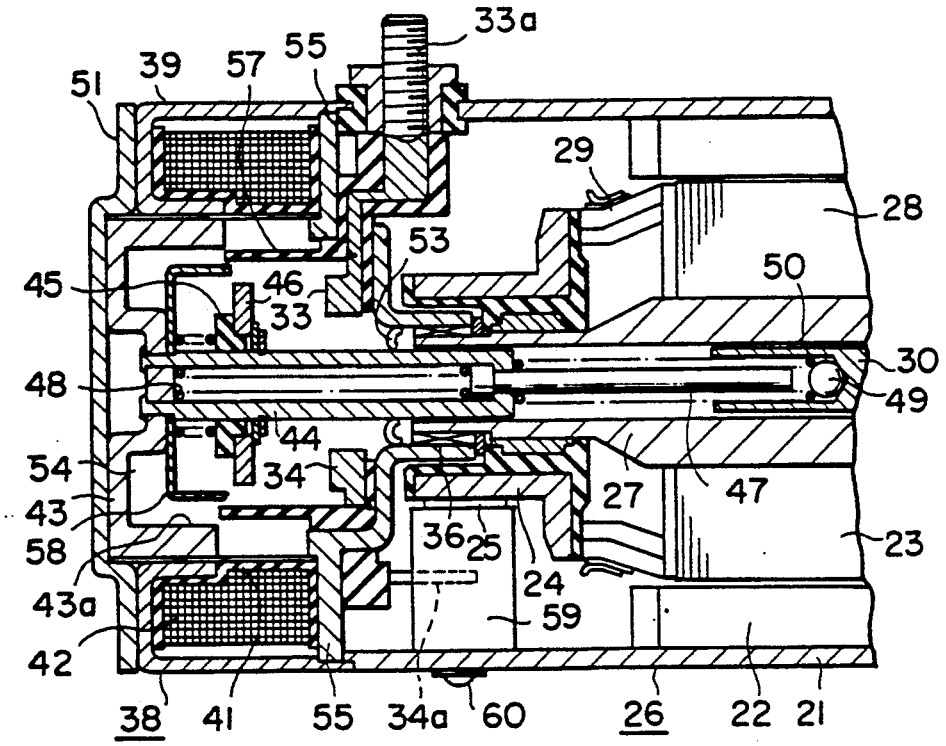
FIG. 7 is a sectional view of the main portion of the coaxial starter of one embodiment of the present invention.
Figure 8:
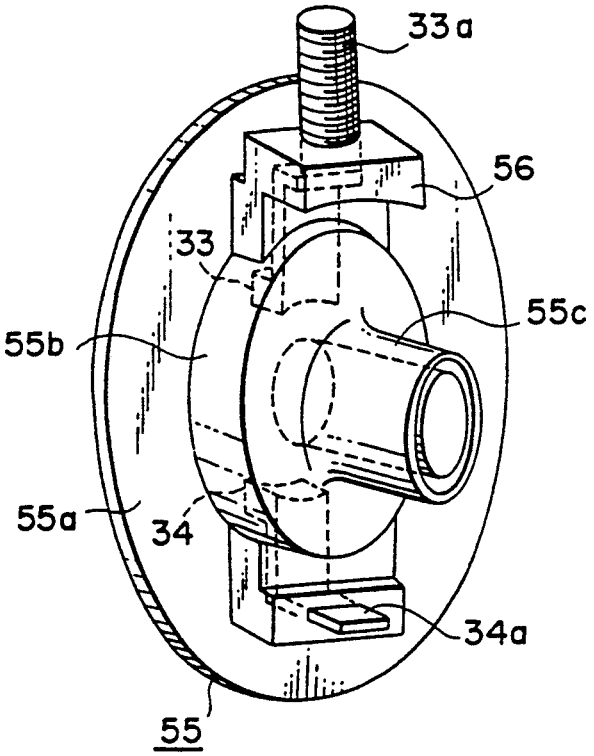
FIG. 8 is a perspective view of the iron core portion of the above coaxial starter motor.

FIG. 7 is a sectional view of the main portion of the coaxial starter of one embodiment of the present invention, and FIG. 8 is a perspective view of the iron core portion of the coaxial starter as viewed from the d.c. motor side. In these figures, 55 indicates an iron core portion defining a magnetic path for the solenoid switch 38, having integrally formed therein a base plate portion 55*a*, a projection portion 55*b* forwardly projecting from the base plate portion 55*a*, and a supporting portion 55*c* projecting further forward from the central portion of the projection portion 55*b* for supporting the armature rotary shaft 27. The iron core portion 55 also has mounted thereon by integral molding an external terminal thread portion 33*a*, a stationary contact 33 electrically connected to the terminal thread portion 33*a*, and a stationary contact 34 and a connecting member 34*a* electrically connected to the brush 25 within an electrically insulating plastic resin material 56 so that these components are electrically insulated from the iron core portion 55. Further, at the rear side of the base plate portion a tubular member 57 having a diameter slightly smaller than the inner diameter of a circumferential wall portion 43*a* of the plunger 43 is integrally formed to extend from the rear end of the plastic resin material 56 to a point close to the front end of the circumferential wall portion 43*a*. Reference numeral 58 indicates a cover integrally attached to the front side of the plunger 43 and having a U-shaped cross section, the cover having a diameter slightly smaller than that of the tubular member 57 and its front end extends until it slightly overlaps the rear end of the tubular member 57.

Further, in the inner circumference of the supporting portion 55c of the iron core portion 55, a bearing 36 is fitted to support the rear end of the armature rotary shaft 27, and the brush holding portion 59 in which the brush 25 is disposed is mounted to the yoke 21 of the d.c. motor 26 by the fastening screw 60.

Figure 1:
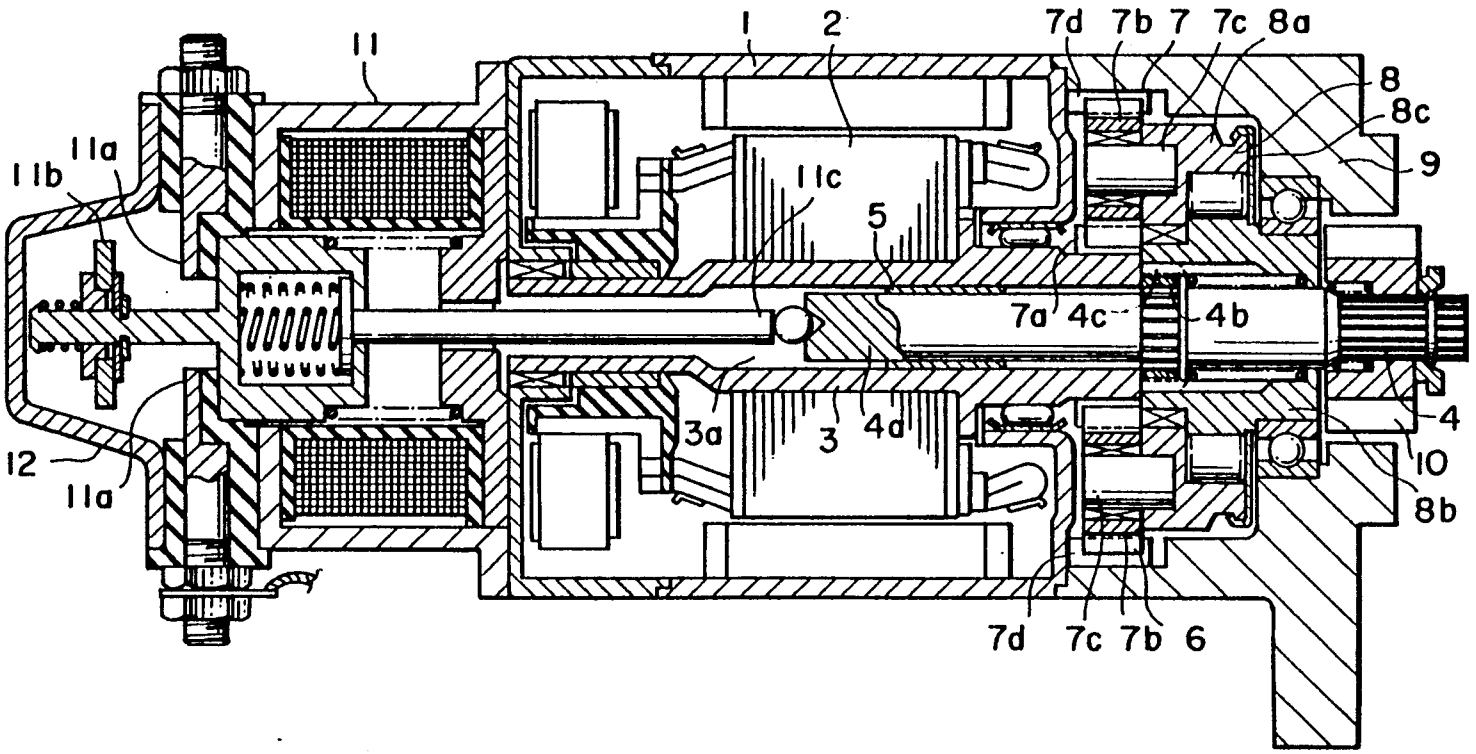
FIG. 1 PRIOR ART
FIG. 1 is a sectional view of a conventional coaxial starter.
Figure 2:
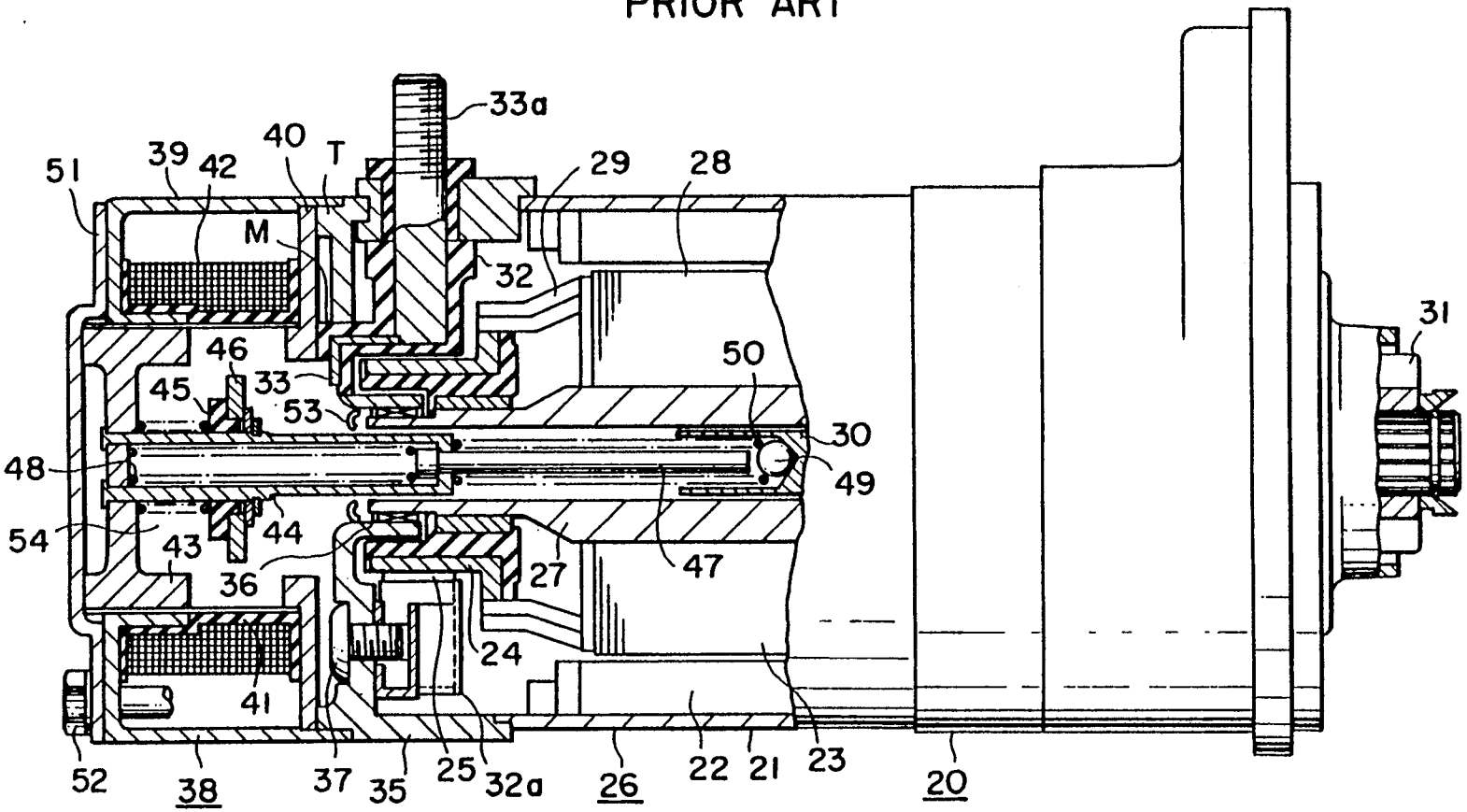
FIG. 2 PRIOR ART
FIG. 2 is a partial sectional view of the coaxial starter of prior proposal.
Figure 3:
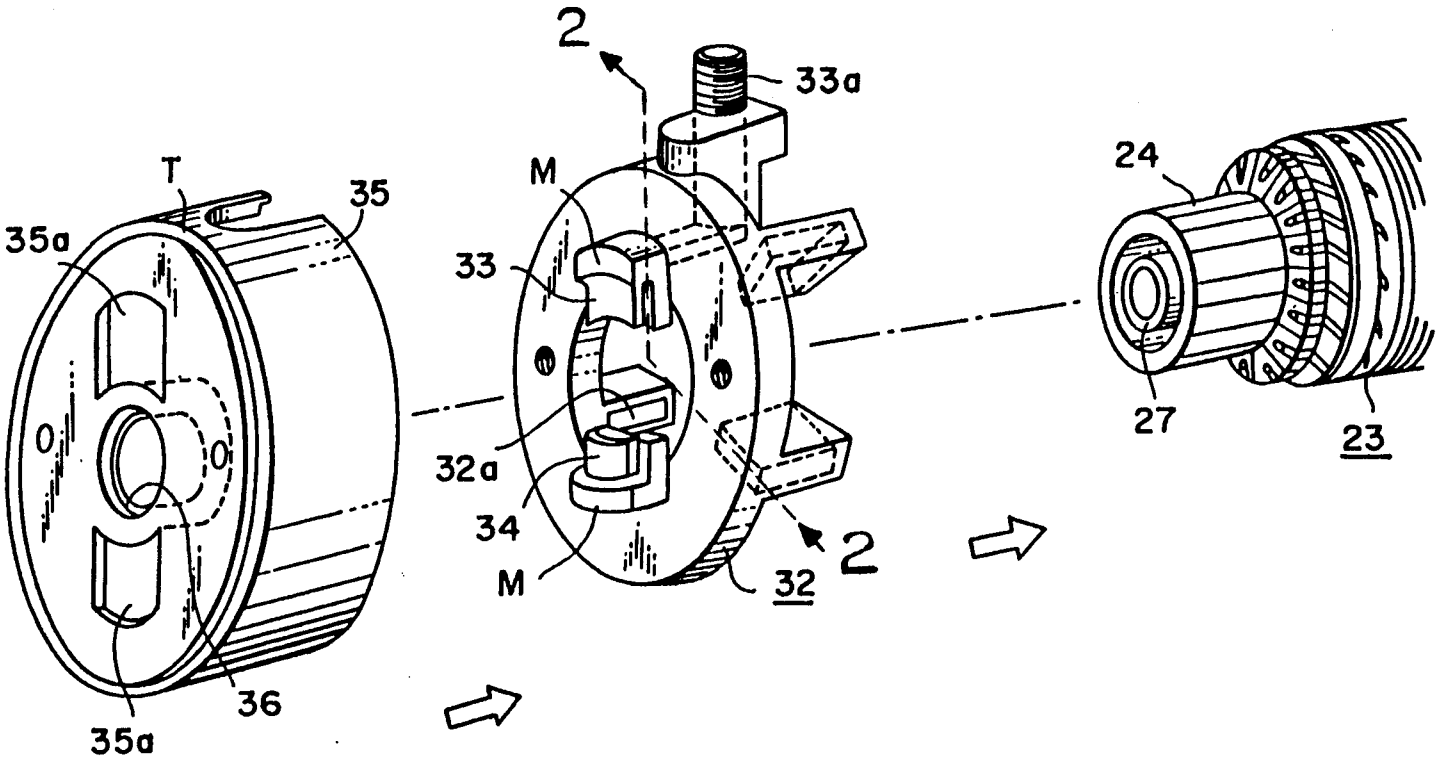
FIG. 3 PRIOR ART
FIG. 3 is an exploded perspective view of the brush assembly.

Further, the construction of other components and the engine starting operation as a starter is identical to those of the coaxial starter shown in FIG. 2, so that their descriptions will be omitted by assigning the same reference numerals to corresponding components.

In the coaxial starter thus constructed, the iron core portion 55 supports the armature rotary shaft 27 as well as the stationary contacts 33 and 34, so that the conventional housing and the brush holder are not necessary, enabling the structure to be simple and the manufacture and the assembly to be easy. Also, there is no large opening such as the through hole of the conventional housing, and the material used is iron, so that a large strength can be obtained and the weight can be decreased.

Further, since the space in which the brush particles are generated and the contact chamber 54 are isolated by the iron core portion 55, the ingress of the brush particles into the contact chamber 54 can be prevented.

Also, the space within the contact chamber 54 in which the movable contact 46 as well as the stationary contacts 33 and 34 is enclosed by the tubular member 57 and the cover 58, and a labyrinth structure is defined by the cover 58, the tubular member 57 and the outer circumferential wall 43a of the plunger 43 between the space and the sliding surface of the plunger 43, so that the attachment of the worn particles of the contact generated by the abutment of the movable contact 46 and the stationary contacts 33 and 34 as well as the worn particles generated between the movable contact 46 and the insulating material 45 to the sliding surface of the plunger 43 can be prevented.

Figure 9:
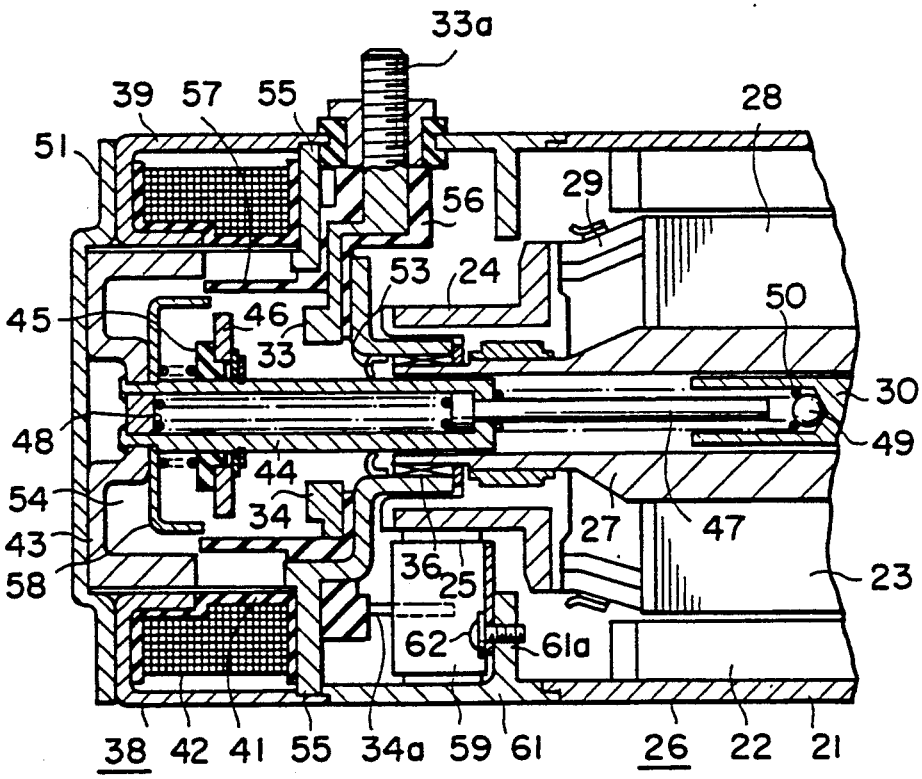
FIG. 9 is a sectional view of the main portion of the coaxial starter of another embodiment of the present invention.

While the brush holding portion 59 of the above embodiment is secured to the yoke 21 of the d.c. motor 26, it may also be secured to a rear bracket 61 which is disposed between the yoke 21 and the casing 39 of the solenoid switch 38, this being illustrated in FIG. 9 as an alternative embodiment. That is, the rear bracket 61 is fitted between the yoke 21 and the casing 39 and includes a ring-shaped portion 61a radially inwardly extending from the inner circumference to which the brush holding portion 59 is mounted by the mounting screw 62. Thus, the mounting of the brush holding portion 59 can be easy.

Also, the stationary contacts 33 and 34 are integrally molded together with the iron core portion 55 by the plastic resin material 56 in the above embodiments, screw fasteners may equally be used to secure the components such as the stationary contacts 33 and 34 or the like to the iron core portion 55 through an insulating material.

Also, while the iron core portion 55 is described in the above as being separately formed with respect to the casing 39 of the solenoid switch 38, the casing 39 and the iron core portion 55 may be formed integral to each other.

Further, while the lengths of projections of the rear end of the tubular member 57 and the front ends of the cover 58 and the circumferential wall of the plunger 43 are selected to terminate at substantially the same axial position in the above-described embodiments, this projection length can also be further increased as far as the operation of the plunger 43 is not obstructed, and particularly it is preferable that the rear end of the tubular member 57 extends inwardly beyond the front end of the circumferential wall portion 43a of the plunger 43. While the attachment of the contact particles or the like to the sliding surface 43a of the plunger 43 can be more effectively prevented by the provision of the cover 58, an arrangement in which this is omitted and the tubular member 57 alone is used.

As has been described, according to the present invention, the interior space of the motor and the solenoid switch is separated by the iron core portion, and the stationary contacts are mounted to the iron core portion, so that the structure can be made simple and the light-weight by strengthening the armature rotary shaft as a bearing, and the ingress of the brush particles into the interior space of the solenoid switch is prevented, so that the possibility of the improper sliding movement of the plunger and the poor contact of the contacts can be removed.

Figure 4:
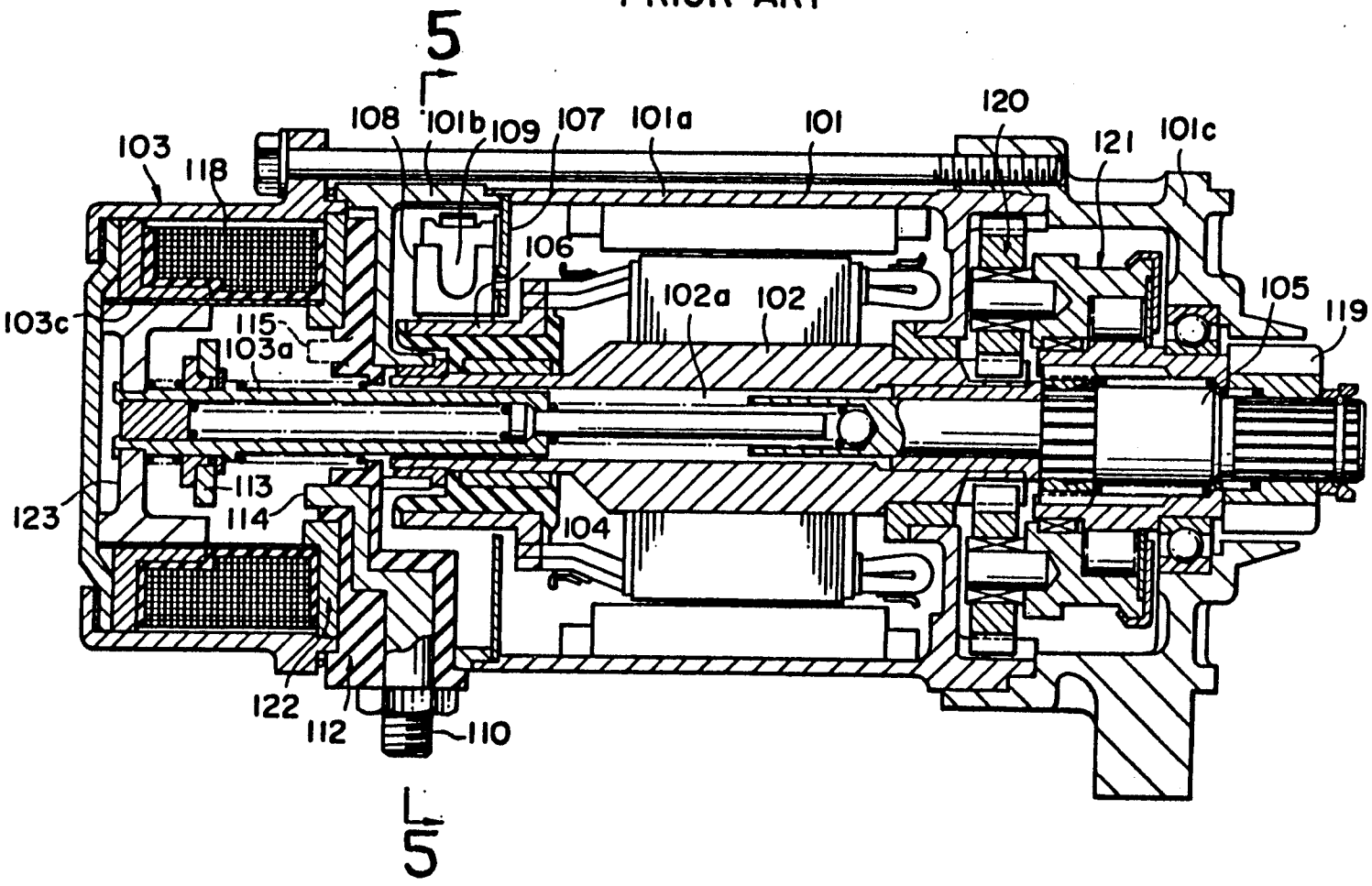
FIG. 4 PRIOR ART
FIG. 4 is a sectional view showing another conventional coaxial starter.
Figure 5:
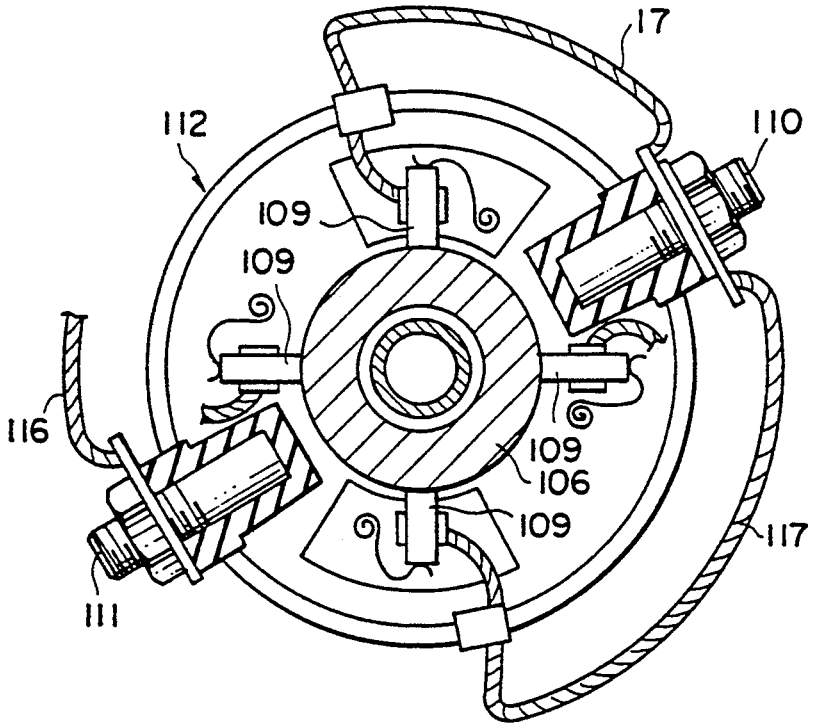
FIG. 5 PRIOR ART
FIG. 5 is a sectional view of the conventional coaxial starter taken along line 5—5 of FIG. 4.
Figure 6:
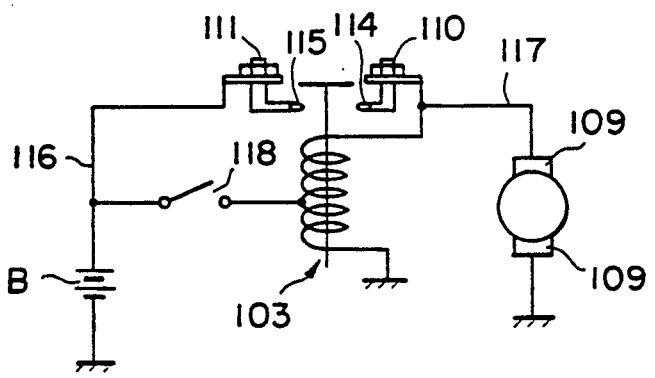
FIG. 6 is an electrical circuit diagram of the typical starter.
Figure 10:
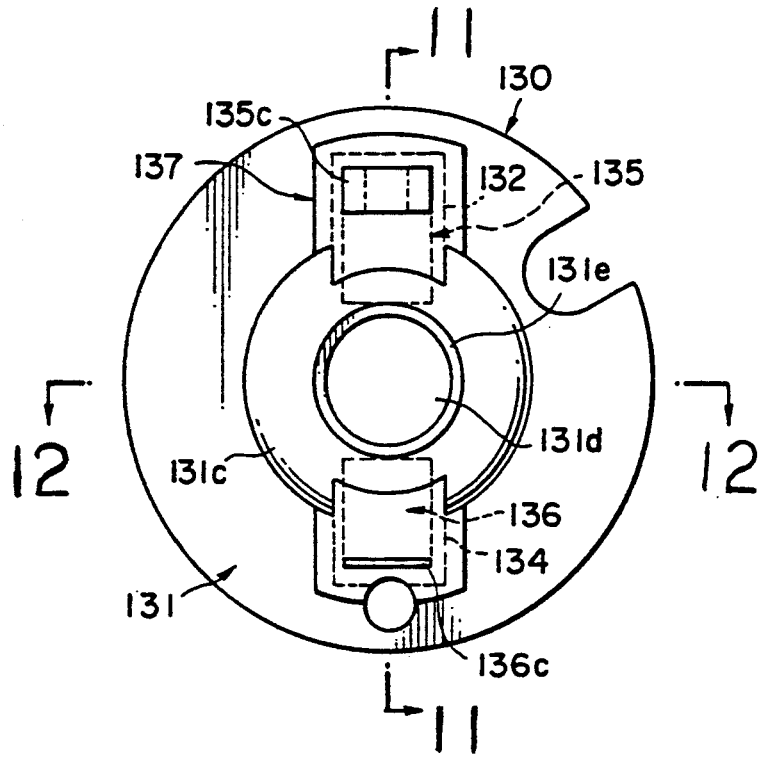
FIG. 10 is a front view illustrating the core and contact terminal assembly of one embodiment of the present invention.
Figure 11:
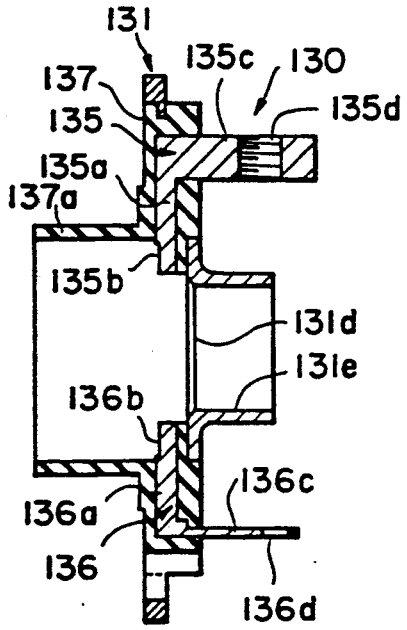
FIG. 11 is a sectional view of the core and contact terminal assembly taken along line 11—11 of FIG. 10.
Figure 12:
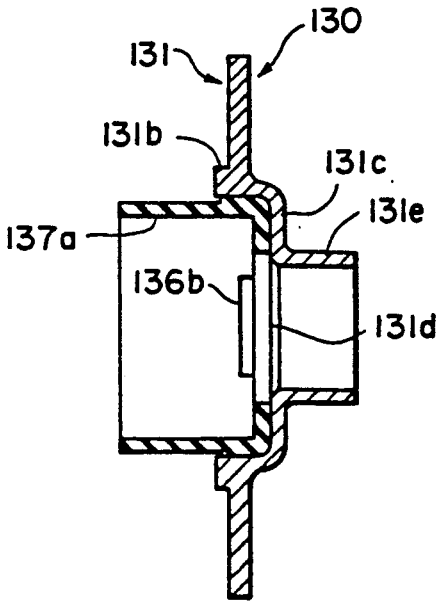
FIG. 12 is a sectional view of the core and contact terminal assembly taken along line 12—12 of FIG. 10.
Figure 15:
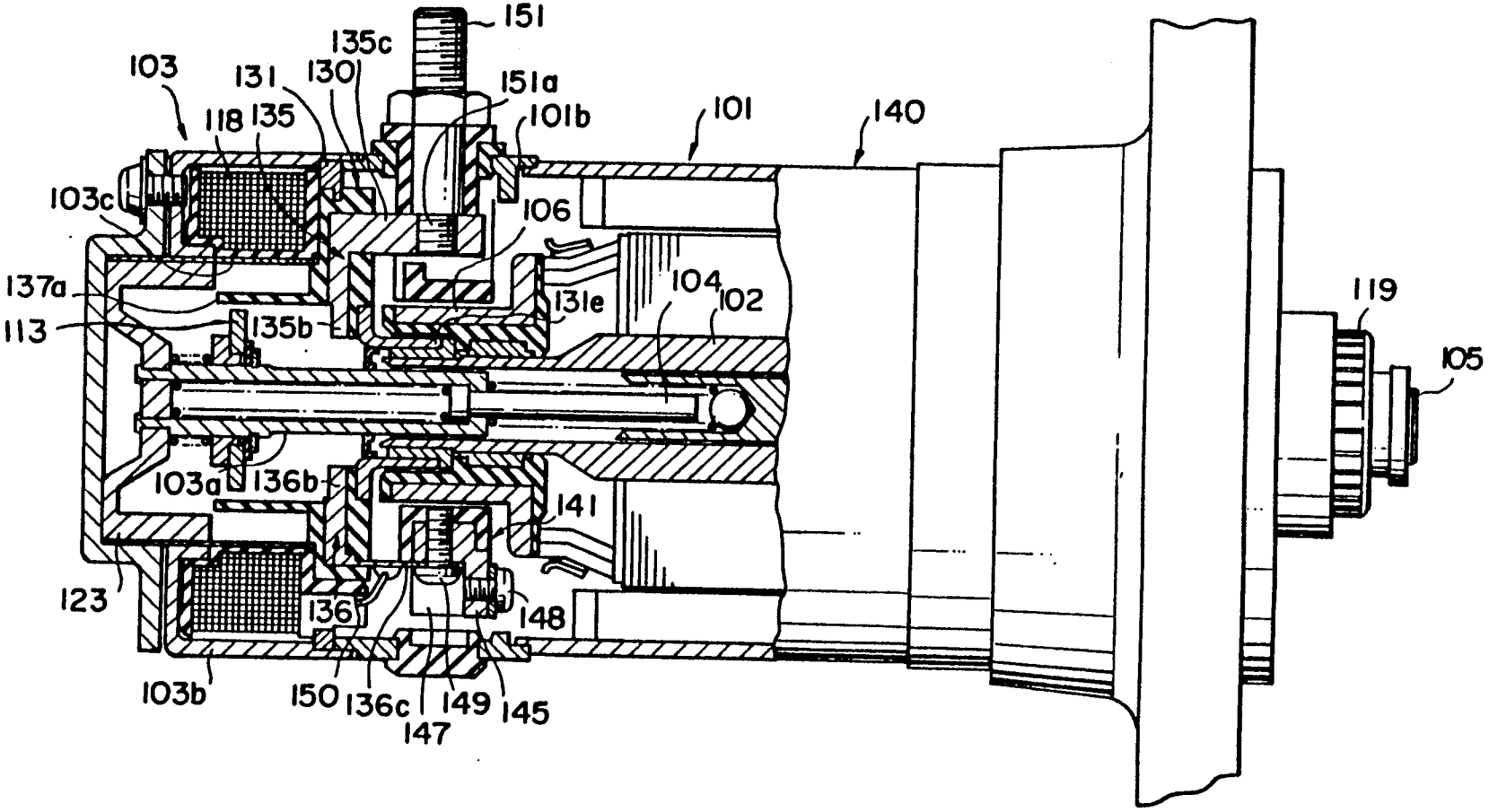
FIG. 15 is a partial sectional view showing the coaxial starter utilizing the core and contact terminal assembly of the embodiment shown in FIG. 10.

FIGS. 10 to 12 illustrate a core and contact terminal assembly 130 of the present invention, and FIG. 15 illustrates a coaxial starter 140 constructed by utilizing the core and contact terminal assembly 130 shown in FIG. 10 with its main portion shown in section. Particularly in FIG. 15 in which the coaxial starter 140 is illustrated, the components the same as or corresponding to those of the conventional coaxial starter shown in FIG. 4 are indicated by identical reference numerals and their explanations will be omitted.

Figure 13:
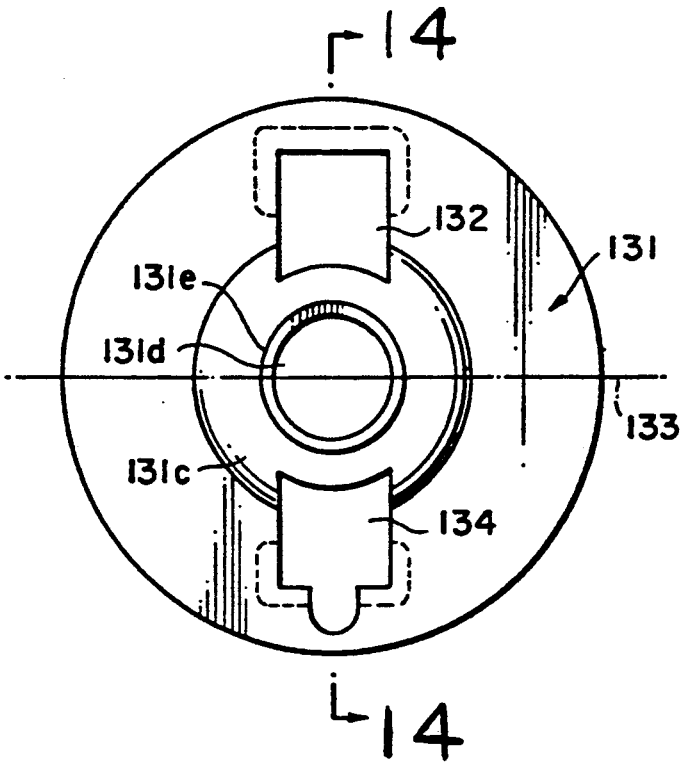
FIG. 13 is a front view showing the core of the core and contact terminal assembly shown in FIG. 10.
Figure 14:
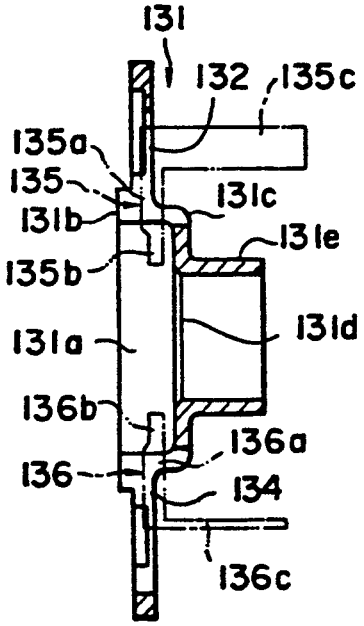
FIG. 14 is a sectional view of the core taken along line 14—14 of FIG. 13.

The core and contact terminal assembly 130 of this embodiment comprises a generally disc-shaped iron core 131 as shown in FIGS. 13 and 14, the central portion of the core 131 is swelled out on one side as shown in FIG. 14, thereby providing a circular recessed portion 131a on the other side of the core 131 with its peripheral edge portion slightly projected to define a suction force generating portion 131b. The central portion of this swelled portion 131c has formed therein an opening 131d and a tubular portion 131e extending from one side of the core 131 is integrally formed at the periphery of the opening 131d. This tubular portion 131e fits over and supports the rear end of the armature shaft 102 when the core and contact terminal assembly 130 is assembled into the coaxial starter.

This core 131 additionally has formed therein a rectangular removed portion or a window 132 extending radially from an area close to the outer circumferential portion to the swelled-out portion 131c as shown in FIG. 13, and another window similar to the window 132 is also formed in a symmetrical relationship with respect to a diametrically crossing imaginary line 133 passing through the center of the core 131, this window being indicated by reference numeral 134. These windows 132 and 134 has mounted therein stationary contacts 135 and 136, respectively, as shown in FIG. 11 or 14. These stationary contacts 135 and 136 have main body portions 135a and 136a of the configuration which can be arranged substantially on the same plane as that of the core 131, and contact portions 135b and 136b which are ends of the respective main body portions 135a and 136a are extended in the radially inward direction to terminate within the recessed portion 131a. Also, the other ends of the respective main body portions 135a and 136a has integrally formed thereon connecting terminal portions 135c and 136c which extends substantially axially and substantially perpendicularly to the main body portions, and each of the connecting terminal portions 135c and 136c has formed therein a threaded hole 135d or a through hole 136d through which the screw extends.

As shown in FIG. 14, when the stationary contacts 135 and 136 are disposed within the windows 132 and 134 of the core 131, a resin material 137 is disposed in the windows 132 and 134 so as to secure the stationary contacts 135 and 136 to the core 131 and to establish an electrical connection therebetween, to resin mold (embedment) the main body portions 135a and 136a except for the contact portions 135b and 136b and portions of the tips of the connecting terminal portions 135c and 136c except for their tips as apparent from FIG. 11. This resin portion 137 is substantially in alignment with the windows 132 and 134, but the circumferential periphery of the windows 132 and 134 are also molded and additionally partly intrudes into the recessed portion 131a as apparent from FIG. 10 to serve as the bonding agent for the core 131. Further, the resin portion 137 has integrally formed on the other side of the core 131 a tubular portion 137a extending in the axial direction.

The description will now be made with reference to FIG. 15 as to the case where the core and contact terminal assembly 130 as above constructed is assembled into a coaxial starter 140. The core and the contact terminal assembly 130 is mounted in an armature side front (the right side as viewed in FIG. 15) of the casing 103b of the solenoid switch 103 with the outer circumferential portion of the core 131 fitted thereinto, to constitute the solenoid switch 103 together with the casing 103b, the plunger 123, the movable contact 113, the contact shaft 103a, the coil 118, the bush 103c and the like.

Figure 16:
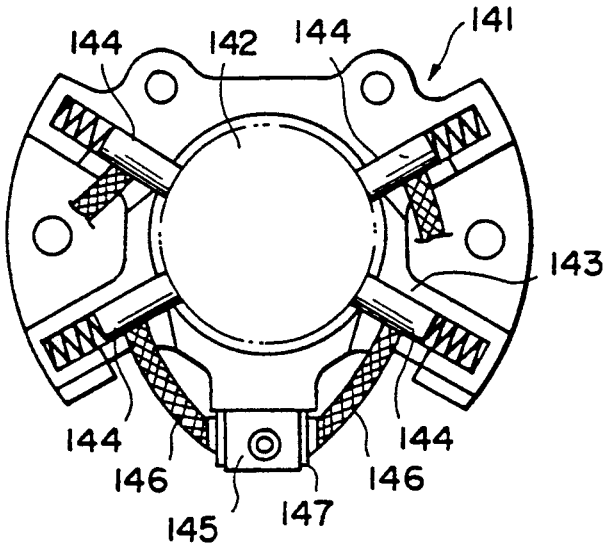
FIG. 16 is a front view showing the terminal bed used in the coaxial starter shown in FIG. 15.
Figure 17:
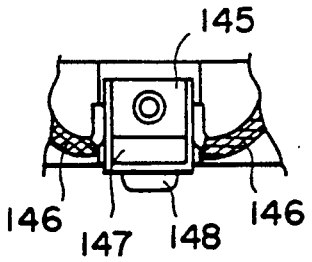
FIG. 17 is an enlarged fragmental bottom view showing the connector terminal portion of the terminal bed shown in FIG. 16.

A component referred to as a terminal bed 141 is disposed at the position where the commutator 106 mounted to the armature rotary shaft 102 of the d.c. motor 101 is located. This terminal bed 141 includes a plate 143 made of a resin having a central opening 142 for allowing the passage of the commutator 106 as shown in FIGS. 16 and 17. On one side surface of the plate 143 four brushes 144 are movably held in the radial direction of the opening 142. At the lower end of the plate 143 a connector terminal portion 145 is secured by resin molding, and the connector terminal portion 145 has formed therein two threaded holes, one of which is for being thread engaged by a screw 148 for mounting a U-shaped connector fitting 147 to which a lead wire 146 extending from a positive brush 144 is connected is thread engaged.

To the connector terminal portion 145 of the terminal bed 141, the connecting terminal portion 136c of one of the stationary contacts 136 of the core and contact terminal assembly 130 is mounted by a screw 149. At this time, a lead-out wire 150 extending from the current coil 118 of the solenoid switch 103 is connected to the connecting terminal portion 136c by soldering or the like.

Also, the connecting terminal portion 135c of the other stationary contacts 135 is electrically connected to the terminal bolt 151 by thread engaging the lower end bolt portion 151a of the terminal bolt 151 into the threaded hole 135d of the connecting terminal portion 135c.

Further, the tubular portion 137a integral with the resin portion 137 of the core and contact terminal assembly 130 surrounds and shields the movable contact 113 over its moving range so that contact power or the wear particles generated upon the contact between the contact portions 135b and 136b of the movable contact 113 and the stationary contacts 135 and 136 do not attach to the inner circumferential surface of the bush 103c on which the outer circumferential surface of the plunger 123 slides.

With the core and contact terminal assembly 130 of the above construction, the core, the stationary contacts, the armature shaft support member, etc. which have been separate components in the conventional design are incorporated into a single unit, so that it is not only inexpensive and strong in support strength for the stationary contacts or the like, most of the wires outside of the motor frame can be treated (the lead wires from the positive side brush and the current coil lead-in wires are collectively connected in the connector terminal portion) within the machine frame, improving the degree of freedom of layout of the machine relative to the engine.

While the connecting terminal portion 135c of the other stationary contact 135 and the terminal bolt 151 of the core and the contact terminal assembly 130 of the above-described embodiment are separate members, they may be integrally formed.

As has been described, according to the core and contact terminal assembly of the present invention, since the core and the stationary contacts are integrally molded and secured, the assembly can be made high in support strength and inexpensive, and since the main body portions of the stationary contacts are arranged on the same plane as the core, the axial dimension can be made short.

What is claimed is:

1. A coaxial starter which includes an armature rotary shaft of an electric motor, an output rotary shaft having a pinion at a front end thereof, said output rotary shaft being slidable in an axial direction, said electric motor including a brush and commutator space in which a brush slidably contacts a commutator of said electric motor, said coaxial starter comprising: a solenoid switch disposed on a rear end of said electric motor, said solenoid switch and electric motor being arranged along a common axis, an iron core portion which defines a magnetic path for said solenoid switch, said iron core portion including a supporting portion which extends along said common axis and journals said armature rotary shaft, such that said iron core portion separates said brush and commutator space from an internal space of said solenoid switch, a power source side stationary contact connected to an external terminal of said starter and a brush side stationary contact connected to said brush, said stationary contacts being integrally mounted, through an insulating material, to said iron core portion.

2. A core and contact terminal assembly for a solenoid switch, comprising a casing containing therein a bobbin on which a solenoid coil is wound, a plunger slidably mounted along an inner circumferential surface of said bobbin, a disc-shaped core disposed at an axial end portion of said casing, a movable contact supported on said plunger being engageable with two stationary contacts, wherein main body portions of said two stationary contacts are disposed within a contact chamber, and said slidable plunger is located outside said contact chamber, said main body portions of said stationary contacts and an insulating portion of said core are securably embedded in a resin material, said casing further including a tubular member which defines said contact chamber.

3. The coaxial starter of claim 1, wherein said iron core portion further includes a projection portion which extends forwardly along said axial direction, such that said supporting portion extends forwardly from said projection portion, a terminal thread portion molded into said iron core, said terminal threaded portion being electrically connected to the stationary contact, such that said iron core portion isolates said brush and commutator area from said internal space.

4. The core and contact terminal assembly of claim 2, further comprising a cover attached to said plunger, wherein said cover slidably interacts with said tubular member in order to define one side of said contact chamber, thereby preventing debris from entering said control chamber.

* * * * *